United States Patent [19]

Rein

[11] 4,008,574

[45] Feb. 22, 1977

[54] POWER PLANT WITH AIR WORKING FLUID

[76] Inventor: Charles R. Rein, 103 Carolyn Ave., Panama City, Fla. 32401

[22] Filed: Oct. 20, 1975

[21] Appl. No.: 623,880

[52] U.S. Cl. ..... 60/682; 60/516; 60/683

[51] Int. Cl.[2] ..... F02G 1/02

[58] Field of Search ..... 60/517, 522, 526, 650, 60/682, 683, 516

[56] References Cited

UNITED STATES PATENTS

| | | | |
|---|---|---|---|
| 1,926,463 | 9/1933 | Stoddard | 60/650 X |
| 2,464,861 | 3/1949 | Harverstick | 60/683 |

FOREIGN PATENTS OR APPLICATIONS

| | | | |
|---|---|---|---|
| 26,183 | 11/1912 | United Kingdom | 60/682 |
| 6,353 | 4/1915 | United Kingdom | 60/682 |

*Primary Examiner*—Allen M. Ostrager
*Attorney, Agent, or Firm*—Richard S. Sciascia; Don D. Doty; Harvey A. David

[57] ABSTRACT

An open circuit heat engine, utilizing air as the working fluid, is described wherein an intermittent flow heat exchanger recovers heat energy from spent air to add heat to air prior to expansion into the working chamber.

8 Claims, 5 Drawing Figures

POWER PLANT WITH AIR WORKING FLUID

STATEMENT OF GOVERNMENT INTEREST

The invention described herein may be manufactured and used by or for the Government of the United States of America for governmental purposes without the payment of any royalties thereon or therefor.

FIELD OF THE INVENTION

This invention relates generally to expansible chamber caloric power plants, and more particularly to improvements in hot air engines. A variety of heat engines have been devised in the past that have used air or other fluid as the working medium. Some of the advantages that are manifest in all hot air engines include the ready supply of free working fluid, the freedom from concern of toxicity and corrosiveness, and freedom from need of storage facilities for the working fluid.

With the present day search for more efficient and complete uses of energy producing fuels, and with present concern about pollution of our atmosphere with products of combustion or escaping working fluids, especially such as "Freon," the hot air engine is believed to be worthy of renewed attention. With respect to efficient use of fuels, the hot air engine is noteworthy in its capability of operation on heat energy that is otherwise wasted, for example in stack exhaust gases of boiler systems, heat from the sun, and the like. Of course, such engines are operable as well on heat generated primarily therefor through fuel combustion, or the like.

DISCUSSION OF THE PRIOR ART

In the past, heat engines of the hot air variety have been cumberson, heavy, and notably inefficient in use of heat energy. Their success has generally been limited to novelty use or to stationary applications requiring relatively low power, slow speed rotary input.

One predominant configuration of hot air engine utilizes a large piston, often referred to as a displacer, for transferring hot air from a heating zone to a cooling zone and from the cooling zone back to the heating zone. The alternate expansions and contractions of the air operate on a usually smaller working or power piston, the other side of which is subject to atmospheric pressure. The working and displacer pistons are linked to a crankshaft carrying a flywheel and reciprocate in suitably timed relation wherein the reciprocations of one piston lead those of the other. These engines are typified by U.S. Pat. No. 566,785 to E. Mihsbach, et al.

In another known form of hot air engine, described in U.S. Pat. No. 1,326,092 to G. R. Pratt, a smaller displacer piston is arranged for simultaneous reciprocations with a larger working or power piston, the engine comprising suitably timed valves for controlling air flow to and from the various heating, transfer, working and cooling spaces thereof.

In each of the foregoing, air is heated by combustion of a suitable fuel, such as gasoline or coal, in a continuously operating burner. Air, in each, is cooled by use of water, either in a jacketed portion of a cylinder or in a water tube heat exchanger, thereby requiring a constant supply of cooling water in order to achieve the modest degree of efficiency of which those engines are capable. Clearly, considerable heat is lost or expended in heating the cooling water.

Also, each of those representative engines operate in what may be characterized as a closed circuit in that the air working fluid is recirculated or repeatedly passed back and forth between the hot and cold regions. Because of the closed circuit character of these systems, and because of the necessary pressure excursions at various points in the recirculation or air return path, considerable work is expended or lost in the simple process of causing those fluctuations. These may be regarded as pumping work losses.

SUMMARY OF THE INVENTION

The present invention aims to overcome most or all of the disadvantages of the prior art by providing a particularly efficient heat engine that avoids work loss by operating as an open circuit, that utilizes heat of spent air to heat incoming air to avoid heat loss, and which, in certain embodiments can operate with some of the characteristics of an internal combustion engine. In the preferred forms of the invention there is utilized an air to air heat exchanger of a type that is particularly efficient in intermittent or pulsating flow systems.

With the foregoing in mind, it is a principal object of this invention to provide a novel and efficient power plant utilizing air as the working fluid.

Another object of the invention is the provision of a heat engine which can operate efficiently in an open circuit manner, thereby avoiding certain losses in energy which would be expended in pumping.

Still another object of the invention is to provide a hot air engine comprising, in combination, primary air heating means, variable volume displacement and power chambers, and secondary heating means in the form of intermittent flow heat exchanger means for recovering the heat of air exhausted from the power chamber.

Yet another object of the invention is to provide a heat engine of the foregoing character wherein the primary air heating means may be in the form of a heat exchanger to use heat from an external source, or may be in the form of a combustion chamber wherein hot air exhausted from the power chamber is utilized to support combustion of a heat and gas producing fuel.

A further object of the invention is the provision of an improved heat engine that is capable of efficiently providing power while operating at low peak temperatures and pressures compared to existing engines.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
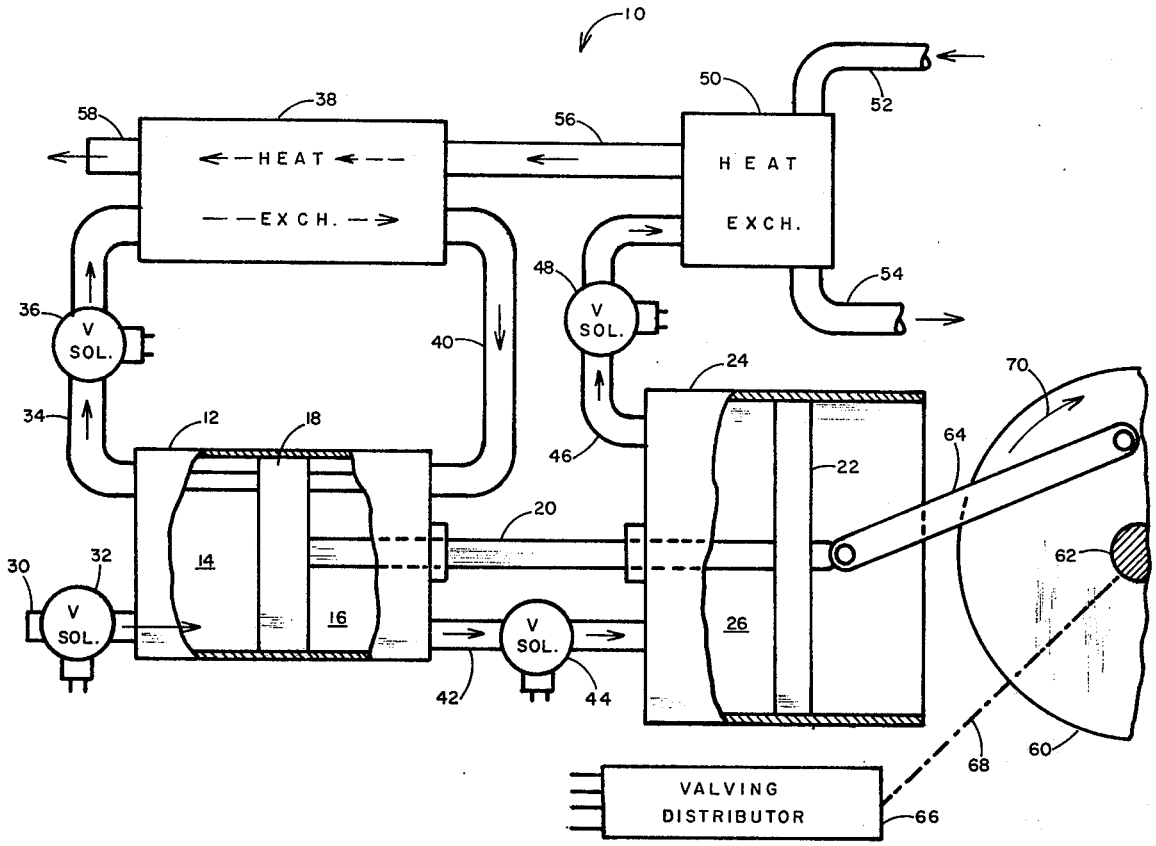
FIG. 1 is a diagrammatic illustration of a hot air engine embodying the invention.

In the form of the invention illustrated in FIG. 1, there is provided a heat engine 10 that utilizes air as the working fluid. Engine 10 comprises a first cylinder 12 that is divided into two variable volume chambers 14 and 16 by a piston 18 reciprocable therein. Piston 18, which may be referred to as a displacer piston, is connected by a connecting rod 20 to a working piston 22 reciprocable in a second cylinder 24. Cylinder 24 and piston 22 define a third variable volume chamber 26. It will be noted at this point that the effective area of piston 22 is considerably greater than that of the piston 18 to which it is connected by rod 20.

An air inlet conduit 30, through which flow is controlled by a valve 32, provides for entry of air into chamber 14. An air conduit 34, through which flow is controlled by a valve 36, is connected between chamber 14 of cylinder 12 and a heater exchanger 38. An air conduit 40 leads from the heat exchanger 38 to the chamber 16 of cylinder 12.

Connected between chamber 16 of cylinder 12 and chamber 26 of cylinder 24 is an air conduit 42, through which flow is controlled by a valve 44. Flow of air from chamber 26 is provided for by a conduit 46, controlled by a valve 48, connected to a second or heat input heat exchanger 50. Heat exchanger 50 is connected by an inlet or supply conduit 52 to a suitable source of heating fluid which may conveniently be waste from some other process, e.g. hot stack gasses from a boiler, internal combustion engine, or the like. Of course, heat may be generated for the primary purpose of insertion via the exchanger 50. A conduit 54 is provided for discharge of heating fluid from the exchanger.

Extending from heat exchanger 50 to heat exchanger 38 is a heated air conduit 56. Air that passes through that conduit and through heat exchanger 38 is discharged from the latter via an exhaust conduit 58.

A flywheel 60 is supported for rotation by a shaft 62 and is operatively connected to piston 22 by an articulated connecting rod 64. Reciprocation of pistons 18 and 22 is accompanied by rotation of flywheel 60 in the usual manner.

Valves 32, 36, 44, and 48 are conveniently solenoid valves electrically connected to an electrical valving distributor 66. Distributor 66 is driven, as shown by line 68, from shaft 62 and may comprise a simple rotary switch of any known construction capable of operating valves 32, 36, 44, and 48 in predetermined timed relation to the rotation of the flywheel and positions of the pistons.

The heat exchangers 38, 40 are advantageously of a type that is particularly efficient in intermittent flow operation. Such a heat exchanger is described in U.S. Pat. No. 3,895,675 issued to the inventor herein.

Figure 2:
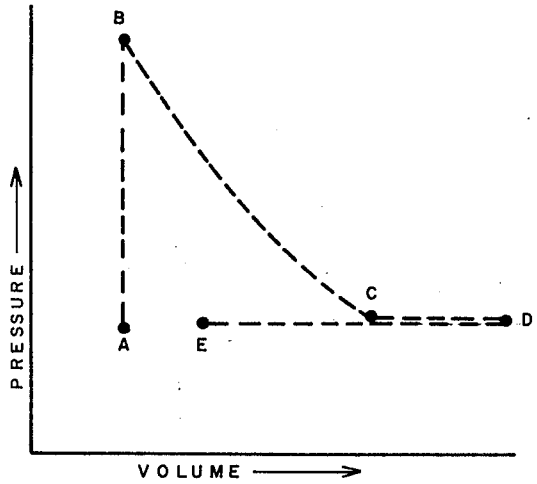
FIG. 2 is a graphic illustration of pressure and volume relationships of the working fluid in the engine of FIG. 1.

In the operation of the engine 10, consider the flywheel 60 to be rotating in the direction of arrow 70 so that pistons 18 and 22 are moving to the right, as viewed in FIG. 1. In this condition, valves 36 and 48 are closed and valves 32 and 44 are open. Movement of piston 18 draws ambient atmospheric air into expanding chamber 14. When pistons 18 and 22 have reversed direction and begin moving to the left under the influence of flywheel 60, valves 32 and 44 close and valves 36 and 48 open. Air in chamber 14 is displaced by piston 18 and caused to pass through heat exchanger 38 to chamber 16, the air being heated in its travel through that heat exchanger, but being held at constant volume. The volume of air so heated will rise in pressure as shown by the vertical line AB in the graphic presentation of FIG. 2.

When the pistons again reverse travel direction and begin movement to the right, valves 36 and 48 close and valves 32 and 44 open. The hot air in chamber 16, owing to its elevated pressure expands through valve 44 into chamber 26, where, because of the increased area of piston 22 relative to piston 18, the air acts to urge piston 22 to the right with considerably greater force than is produced against piston 18. Accordingly, the pistons are moved to the right, adding impetus to the rotation of the flywheel 60 and shaft 62, which may be coupled to any desired apparatus for performing useful work. The expansion of the hot air into chamber 26 is substantially adiabatic, thereby being accompanied by a reduction in pressure substantially to atmospheric pressure, as shown by line BC in FIG. 2. At the end of the power stroke of piston 22, which is simultaneous with the intake stroke of displacer piston 18, valves 32 and 44 close and valves 36 and 48 open. Continued rotation of flywheel 60 causes pistons 18 and 22 to move again to the left. Piston 22 moves the air from chamber 26 through heat exchanger 50 wherein the air is subjected to an input of heat energy from the heat source fluid in conduit 52. The resultant heating of the air in exchanger 50 occurs at substantially atmospheric pressure and so is accompanied by an increase in volume. This is represented by trajectory CD in FIG. 2. As the heated air leaves the exchanger 50, it flows through the heat exchanger 38, giving up heat to air being displaced by piston 18 from chamber 14 to chamber 16 through the heat exchanger 38. This exchange of heat is represented by the trajectory DE of FIG. 2 with respect to the air giving up heat, and by the trajectory AB with respect to a new charge of air which is being heated.

It will be seen that the engine 10 delivers one power stroke per revolution of the flywheel 60, and that the flows in the heat exchangers 38 and 50 are intermittent. It will further be seen that heat energy remaining in the air in chamber 26 after each power stroke is utilized thereafter in elevating the temperature of the succeeding charge of air, thereby adding to the efficiency of the engine 10. Moreover, because the engine operates as an open circuit device, wherein air is inspired and discharged at atmospheric pressure, there is no work lost through pumping of the working fluid through a final cooling heat exchanger.

Figure 3:
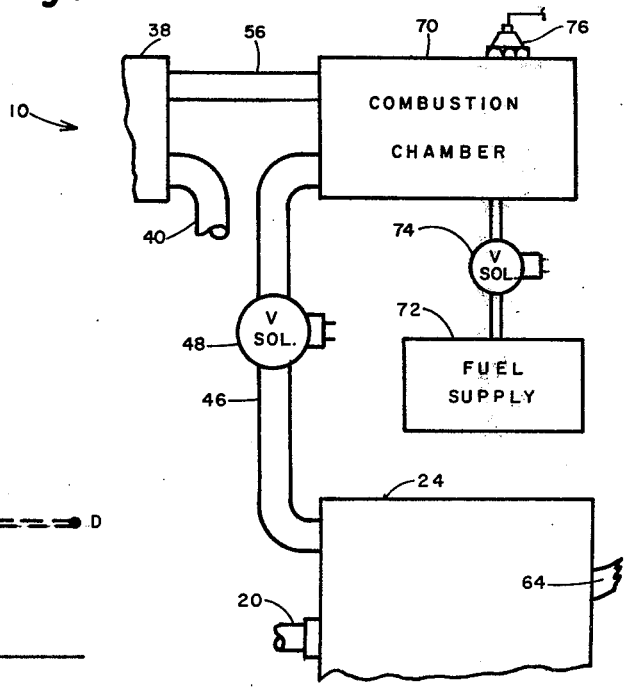
FIG. 3 is a fragmentary diagrammatic illustration of another embodiment of the invention.

Referring now to FIG. 3, a variation of the invention is embodied in an engine shown fragmentally at 10'. Engine 10' differs from engine 10 in that the heat exchanger 50 and heating fluid conduits 52,54 have been replaced by heater means comprising a combustion chamber 70 into which fuel from a supply 72 is injected under the control of a valve 74 for mixture with air exhausted from cylinder 24 by piston 22. The fuel/air mixture is ignited by any suitable means, such as a glow plug 76 to generate hot gases of combustion. These combustion products are passed, via conduit 56, through the heat exchanger 38 to effect heating of air that is displaced, as before, by piston 18 through that heat exchanger.

It will be noted that none of the combustion products are introduced into the cylinders 12,24. Accordingly, the engine 10', like engine 10, can make use of modern, low friction plastics, lubricants and the like without contamination or corrosive destruction thereof.

Figure 4:
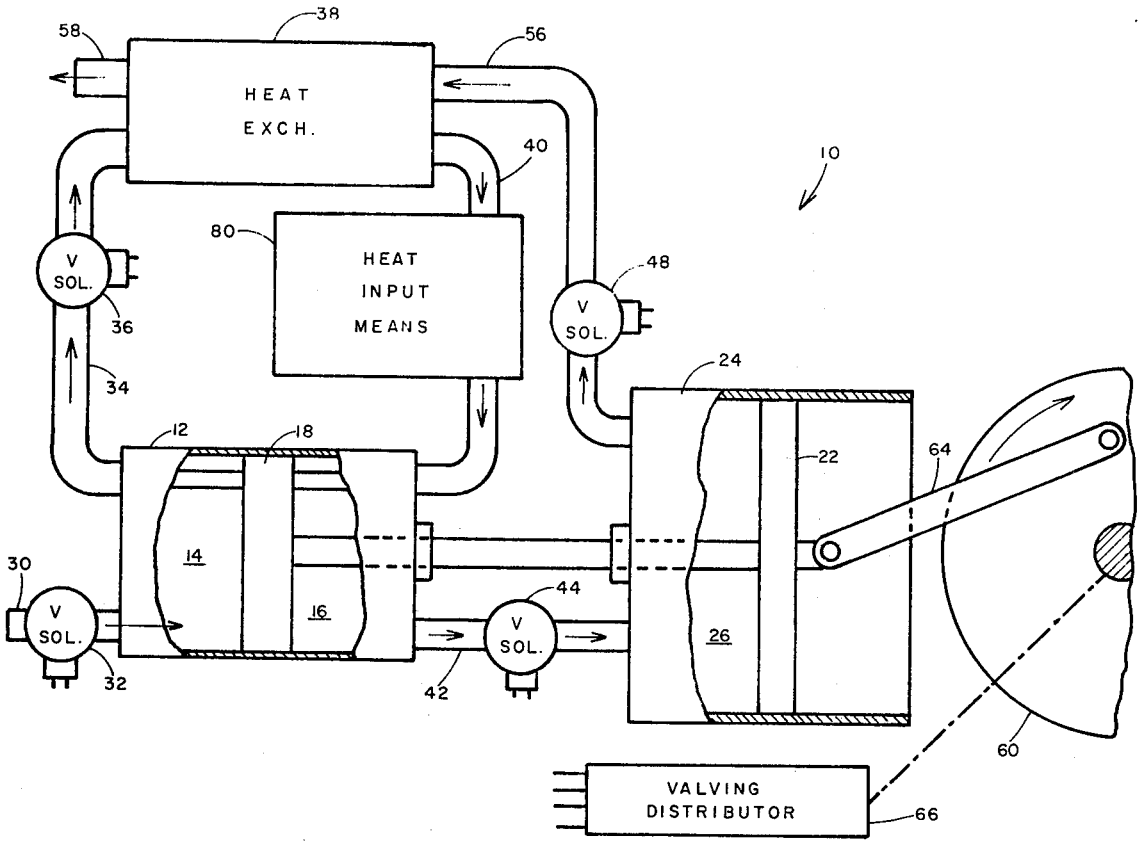
FIG. 4 is a diagrammatic illustration of still another embodiment of the invention.

Turning to FIG. 4, another variation of the invention is embodied in an engine 10''. Engine 10'' differs from engines 10 and 10' in that the input of heat energy is accomplished by a heat input means 80 disposed in the line of flow from heat exchanger 38 to chamber 16 rather than in the line of flow from chamber 26 to heat exchanger 38. Heat input means 80 may comprise, for instance, a heat exchanger similar to heat exchanger 54, or may comprise a combustion chamber similar to chamber 70. In the former instance no combustion products are introduced into the cylinders 12 or 24, whereas in the latter instance they are.

Figure 5:
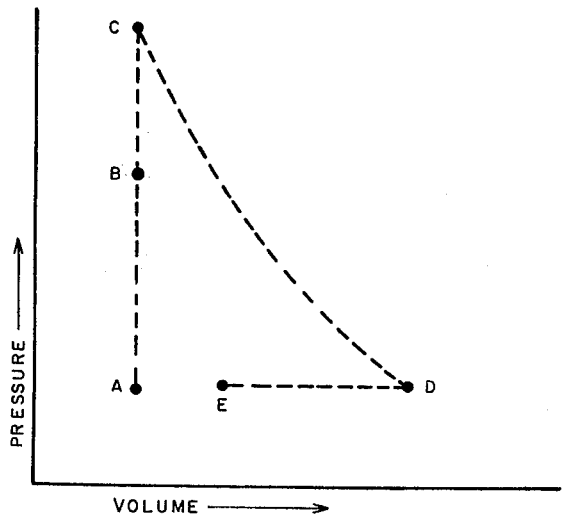
FIG. 5 is a graphic illustration of pressure and volume relationships of the working fluid in the engine of FIG. 4.

The pressure/volume relationship differs slightly in engine 10'', as can be seen from FIG. 5. Thus, heat from spent working fluid is utilized in heat exchanger 38 to heat air from point A to point B in FIG. 5, while the heater means 80 is utilized to heat the air further from point B to point C. Work is extracted during adiabatic expansion to point D, bringing the air substantially to atmospheric pressure, though still at an elevated temperature. Expulsion of the warm air through heat exchanger 38, as shown from D to E in FIG. 5, transfers heat to the subsequent charge of working fluid, and cools the exhaust air for discharge.

It will be understood that, although the variable volume chambers of the preferred engine embodiments described herein are defined by cylindrical walls and linearly reciprocable circular pistons, the invention may as well be practiced in engines wherein the chambers are defined by walls of other shapes, e.g., torroidal, and pistons or vanes of other shapes and reciprocating along other paths than linear. Accordingly, the terms cylinder and piston are intended to include the functional equivalents thereof as is the practice of those skilled in the art to which invention relates.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A heat engine of the character described comprising:

a first cylinder;

a first piston of a first effective area, reciprocable in said first cylinder and dividing said first cylinder into first and second chambers, the volumes of which are respectively increased and decreased with movement of said first piston in said first direction and are respectively decreased and increased with movement of said first piston in the opposite direction;

a second cylinder;

a second piston of a second effective area larger than said first effective area, reciprocable in said second cylinder and defining a third chamber therein, said second piston being interconnected with said first piston so that movement of said second piston in a direction to increase volume of said third chamber is accompanied by movement of said first piston in said first direction, and movement of said second piston in a direction that decreases the volume of said third chamber is accompanied by said movement of said first piston in said opposite direction;

flywheel means, connected to said first and second pistons, for maintaining reciprocations of said pistons;

first valve means for permitting intake of air at substantially ambient pressure into said first chamber during movement of said first piston in said first direction, and for preventing exit of said air during movement of said first piston in said opposite direction;

first conduit means for conducting said air from said first chamber to said second chamber under the influence of said first piston;

second valve means for permitting flow through said first conduit means from said first chamber to said second chamber;

first heater means, disposed in said first conduit means, for imparting heat to said air so as to increase the pressure thereof in said second chamber;

second conduit means for conducting air from said second chamber to said third chamber so as to move said second piston in said direction to increase the volume of said third chamber and provide rotational impetus to said flywheel means;

third valve means for permitting air flow through said second conduit means during predetermined periods relative to the movements of said pistons;

third conduit means for conducting air from said third chamber under the influence of said second piston during said movement in said direction that decreases volume in said third chamber;

fourth valve means for permitting air flow through said third conduit means during predetermined periods relative to the movements of said pistons;

second heater means, disposed in association with one of said first and said third conduit means, for imparting heat to said air;

said first heater means comprising a first heat exchanger connected so as to utilize fluid flowing in said third conduit means as a heating medium for fluid flowing in said first conduit means; and said engine further comprising means coupled to said flywheel means for actuating said valve means so that air is successively inspired into said first chamber at atmospheric pressure, displaced from said first chamber through said first conduit and first heat exchanger to said second chamber, expanded into said third chamber to perform work, passes as spent fluid through said second heating means, thence passes as said heating medium through said first heat exchanger, and exhausted substantially at atmospheric pressure.

2. A heat engine as defined in claim 1, and wherein said second heater means is connected so as to heat fluid flowing in said third conduit means between said second cylinder and said first heater means.

3. A heat engine as defined in claim 2, and wherein said second heater means comprises a second heat exchanger connected to receive a heating medium from an external source and is connected to heat spent air flowing in said third conduit means between said third chamber and said first heat exchanger.

4. A heat engine as defined in claim 2, and wherein said second heater means comprises a combustion chamber, connected to receive spent air from said third chamber, and means for supplying fuel to said combustion chamber whereby combustion of said fuel is supported by said spent air to produce hot gases of combustion as said heating medium in said first heat exchanger.

5. A heat engine as defined in claim 2, and wherein said second heater means comprises a second heat exchanger connected to receive a heating medium from an external source and is connected to heat air flowing in said first conduit means between said first heat exchanger and said second chamber.

6. A heat engine as defined in claim 2, and further comprising valve actuating means, coupled to said flywheel means, for actuating said valve means.

7. A thermal engine of the type wherein atmospheric air is inspired at first temperature and first pressure into a variable volume first chamber, displaced from the first chamber through a heat exchanger at a constant volume to a second variable volume second chamber at an elevated second temperature and elevated pressure, expanded to perform work in a variable volume third chamber, and exhausted from said third chamber as spent working fluid at an intermediate third temperature with respect to said first and said elevated second temperatures, said engine being characterized by the improvement comprising:

heat input means, connected between said third chamber and said heat exchanger, for adding heat to said spent working fluid to provide a heating fluid medium to said heat exchanger at a fourth temperature above said elevated second temperature.

8. A thermal engine as defined in claim 7, and further characterized by:

said first temperature and first pressure being those of ambient air, and said heat exchanger being adapted to discharge said heating fluid medium to atmosphere, whereby said engine operates as an open circuit with respect to working fluid; and said heat input means comprising a second heat exchanger.

* * * * *